US007020296B2

(12) United States Patent
Niederdränk

(10) Patent No.: US 7,020,296 B2
(45) Date of Patent: Mar. 28, 2006

(54) METHOD FOR OPERATING A HEARING AID SYSTEM AND HEARING AID SYSTEM

(75) Inventor: Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 45 days.

(21) Appl. No.: 10/381,155

(22) PCT Filed: Sep. 17, 2001

(86) PCT No.: PCT/DE01/03576

§ 371 (c)(1),
(2), (4) Date: Mar. 21, 2003

(87) PCT Pub. No.: WO02/28143

PCT Pub. Date: Apr. 4, 2002

(65) Prior Publication Data

US 2004/0013280 A1 Jan. 22, 2004

(30) Foreign Application Priority Data

Sep. 29, 2000 (DE) ..... 100 48 354

(51) Int. Cl.
*H04R 25/00* (2006.01)

(52) U.S. Cl. ..... 381/315; 381/312; 381/314

(58) Field of Classification Search ..... 381/23.1, 381/312, 314, 315, 317, 320, 321, 323, 92, 381/60

See application file for complete search history.

(56) References Cited

U.S. PATENT DOCUMENTS

| | | | | |
|---|---|---|---|---|
| 5,420,930 | A | 5/1995 | Shugart, III | |
| 5,604,812 | A | 2/1997 | Meyer | |
| 5,757,932 | A * | 5/1998 | Lindemann et al. | 381/312 |
| 6,549,633 | B1 * | 4/2003 | Westermann | 381/312 |

FOREIGN PATENT DOCUMENTS

| | | |
|---|---|---|
| EP | 1 017 252 | 7/2000 |
| WO | WO 00/00001 | 1/2000 |

* cited by examiner

*Primary Examiner*—Huyen Le
(74) *Attorney, Agent, or Firm*—Schiff Hardin LLP

(57) ABSTRACT

In a hearing aid system having at least two hearing aid devices acoustic field characteristics are generated in the hearing aid devices and are transmitted between the hearing aid devices for adapting the signal processing units to different hearing situations. Both hearing aid devices are thus always operated in the same hearing program.

20 Claims, 2 Drawing Sheets

METHOD FOR OPERATING A HEARING AID SYSTEM AND HEARING AID SYSTEM

BACKGROUND OF THE INVENTION

1. Field of the Invention

The present invention is directed to a method for operating a hearing aid system and to a hearing aid system having at least two hearing aid devices between which a signal path is provided and having at least one signal-processing unit that is adaptable to different hearing situations.

2. Description of the Prior Art

In many instances, a hearing impairment affects both ears; so the hearing impaired person should be supplied with hearing aids in both ears (binaurally). Modern hearing aids have signal-processing algorithms that automatically vary the parameters of the hearing aids dependent on the hearing situation. These variations are directed to the switching between microphone modes (omnidirectional or various directional microphone modes) as well as the effect of various stages of the signal processing thereby allowing adaptation to the hearing situation. In binaural coverage, the hearing situation at both ears is evaluated. However, the evaluation can lead to slightly divergent results due to slightly different acoustic fields at both ears. In the inside of a passenger vehicle, for example, the acoustic levels measured at the two ears can significantly differ; a definitive resolution as to the spatial arrangement of the noise sources also fluctuates greatly. In the case of such a separate evaluation, thus, different settings of the hearing aids can be avoided only with difficulty.

U.S. Pat. No. 5,604,812 discloses a hearing aid device that has a signal analysis unit for the automatic switching between various hearing programs, the signal analysis unit recognizing the current hearing situation and selecting a suitable hearing program. A disadvantage is that the automatic recognition of the hearing situation in the case of a system having two hearing aid devices can lead to different results and, thus, to the operation of the hearing aid devices in different hearing programs.

PCT Application 00/00001 discloses a method for the operation of binaural hearing aids, each of which can be switched in situ into at least two transmission modes from the microphone to the output transducer arrangement (hearing programs). The active hearing programs of the hearing aids are manually or automatically synchronized to prescribed or prescribable program pairings via a wireless connection between the hearing aids. A disadvantage of this known method is that the momentary hearing situation is not correctly recognized, and one of the hearing aids or both hearing aids are operated in a incorrect hearing program.

U.S. Pat. No. 5,757,932 discloses a hearing aid system with at least two hearing aids for binaural coverage of a hearing aid user wherein transmission of acoustic signals between the two hearing aids is provided. A disadvantage of this known hearing aid system is the high quantity of data transmitted between the two hearing aids.

SUMMARY OF THE INVENTION

An object of the present invention is to provide a method for operating a hearing aid system, as well as a hearing aid system, with which the automatic adaptation to different hearing situations is improved.

This object is achieved in accordance with the invention in a method and hearing aid system wherein at least two hearing aid devices communicate with each via a signal path, and wherein at least one of the hearing aid devices has a signal processor therein. Each of the hearing aid devices determines acoustic field characteristics of an acoustic field. The hearing aid device (or devices) containing the signal processor (or respective signal processors) is supplied with the acoustic field characteristics determined by both of the hearing aid devices, and the signal processor is adapted to the acoustic field dependent on both sets of determined acoustic field characteristics.

In the context of the invention, "acoustic field characteristics" are quantities characterizing properties of the acoustic field. These quantities can relate to signal level, frequency spectra, modulation frequencies, modulation depths, noise parts, spatial characteristics, etc., of acoustic signals of the acoustic field. The current hearing situation in which the hearing aid is operated at the moment is not an acoustic field characteristic in the context of the invention.

A hearing aid device of the invention can be a hearing aid worn behind the ear (BTE), a hearing aid worn in the ear (ITE), an entirely or partially implanted hearing aid, a hearing aid worn on the body, a pocket device, an "external processor unit" situated in the immediate environment of a hearing aid and interacting therewith, etc.

The hearing aid system of the invention has at least two hearing aids between which a signal path is provided for data transmission and at least one signal-processing unit that is adaptable to various hearing situations. Such a system, for example, can be composed of a hearing aid worn behind the ear having a microphone for signal pick-up, a signal-processing unit and an earphone for supplying an ear of a hearing impaired person and an auxiliary device carried on the body, an "external processor unit", having a microphone for the signal pick-up. As a rule, however, such a system will include two herring aids worn at the head, each having a microphone for signal pick-up, a signal analysis unit for generating acoustic field characteristics, a signal-processing unit for processing the input signal in adaptation to the hearing loss of the hearing aid user, a control and evaluation unit for determining parameters of the signal-processing unit on the basis of the acoustic field characteristics and an earphone for the signal output.

For adapting the signal-processing unit to different hearing situations, acoustic field characteristics are generated in the hearing aid devices by evaluating the microphone signals and are combined in at least one of the hearing aid devices. All data present in the system for evaluating the acoustic field are then present therein, so that an optimized adaptation of the signal-processing unit to the acoustic field is enabled. Differing from conventional systems, it is not necessary therefor that audio signals or processed audio signals be transmitted, which would mean a considerably higher data volume and, particularly given a wireless connection between the hearing aid devices, would be nearly impossible due to the energy consumption connected therewith and the limited capacity of standard hearing aid voltage sources.

In addition to recognizing the hearing situation, the data combined in a hearing aid device also can serve for feedback recognition. Recognized feedback can then be eliminated by expedient adaptation of the signal processing of the affected hearing aid device.

When the hearing aid system of the invention has two hearing aids for binaural coverage, then acoustic field characteristics preferably are generated in each hearing aid and transmitted to the other hearing aid. The same optimized database for evaluating the acoustic field is then present in both hearing aids, so that their signal-processing units are identically adapted to the acoustic field and can be operated in the same hearing program. When slightly different acoustic conditions prevail at the two hearing aids, which, for example, can occur due to the occlusion of the head or in the interior of a motor vehicle, the control and evaluation unit in each hearing aid effects settings of parameters of the signal-processing unit for adaptation to the hearing situation on the basis of the provided binaural information. Further, the combining of acoustic field characteristics enables additional information to be acquired about the acoustic field geometry.

However, it is also possible that the acoustic field characteristics are combined in only one of the hearing aid devices for determining the hearing situation, and a signal for characterizing the hearing situation is transmitted therefrom back onto further hearing aid devices of the hearing aid system. In a hearing aid system having two hearing aids worn at the head and an external processor unit that has at least one microphone, acoustic field characteristics can be generated in the hearing aids and transmitted to the external processor unit, which in turn generates acoustic field characteristics analogous to the hearing aids. When the external processor unit is in the immediate environment of the hearing aids, additional information about the acoustic field is thus obtained. The information of the external processor unit can be utilized for a decision in the case of a need to match between the results acquired in the hearing aids, or the external processor—as "master"—prescribes the valid acoustic field characteristics for the system or hearing program either manually or automatically.

In an embodiment of the invention, the external processor unit is fashioned as a remote control for the hearing aid system. In addition to the aforementioned functions, thus, functions for comfortable operation of the hearing aid system are united in a single device.

Included, in particular, in the acoustic field characteristics that are transmitted between at least two hearing aid devices of a hearing aid according to the invention, on the basis of which the determination of parameters of at least one signal-processing unit of the hearing aid system ensues, are characteristics with respect to:

the signal level,
the frequency spectra,
the modulation frequencies,
the modulation depths,
the noise parts, as well as
spatial characteristics of acoustic signals of the acoustic field.

The spatial characteristics of the acoustic field can in turn be subdivided in coherence, incident direction of noise signals, incident direction of the useful signal, etc.

For adapting the signal-processing unit of a hearing aid device, in an embodiment of the invention acoustic field characteristics are generated at periodic time intervals and be transmitted between hearing aid devices of the hearing aid system. As a result the hearing aid devices of the system operate in different hearing programs for at most a short time.

In another embodiment a balancing between the hearing aid devices of the hearing aid system ensues by the hearing aid device of the hearing aid system according to the invention registering a relevant change of acoustic field characteristics.

In the simplest case, the adaptation of hearing aid devices of the hearing aid system, however, ensues by manual actuation of an operating element of the hearing aid system by the hearing aid user. The operated element provided therefor can also be arranged on a remote control.

DESCRIPTION OF THE PREFERRED EMBODIMENTS

Figure 1:
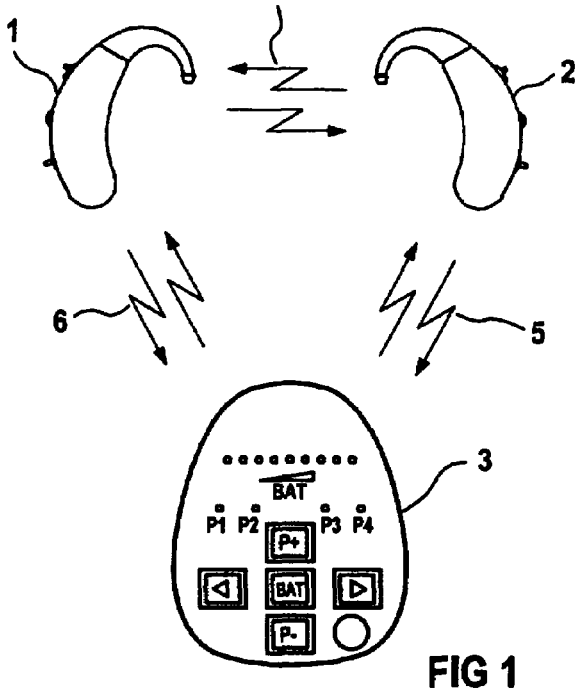
FIG. 1 illustrates a hearing aid system in accordance with the invention, having two hearing aids wearable at the head and an external processor unit.

As an exemplary embodiment, FIG. 1 shows the structure of a binaural hearing aid system with two hearing aids 1 and 2 and an external processor unit 3. Signal paths 4, 5 and 6, which are bidirectionally and wirelessly implemented in the exemplary embodiment, are present between the two hearing aids 1 and 2 and between each hearing aid 1 and 2 and the external processor unit 3. Data thus can be exchanged between the hearing aids 1 and 2 as well as between each hearing aid 1 and 2 and the external processor unit 3 within the hearing aid system.

Figure 2:
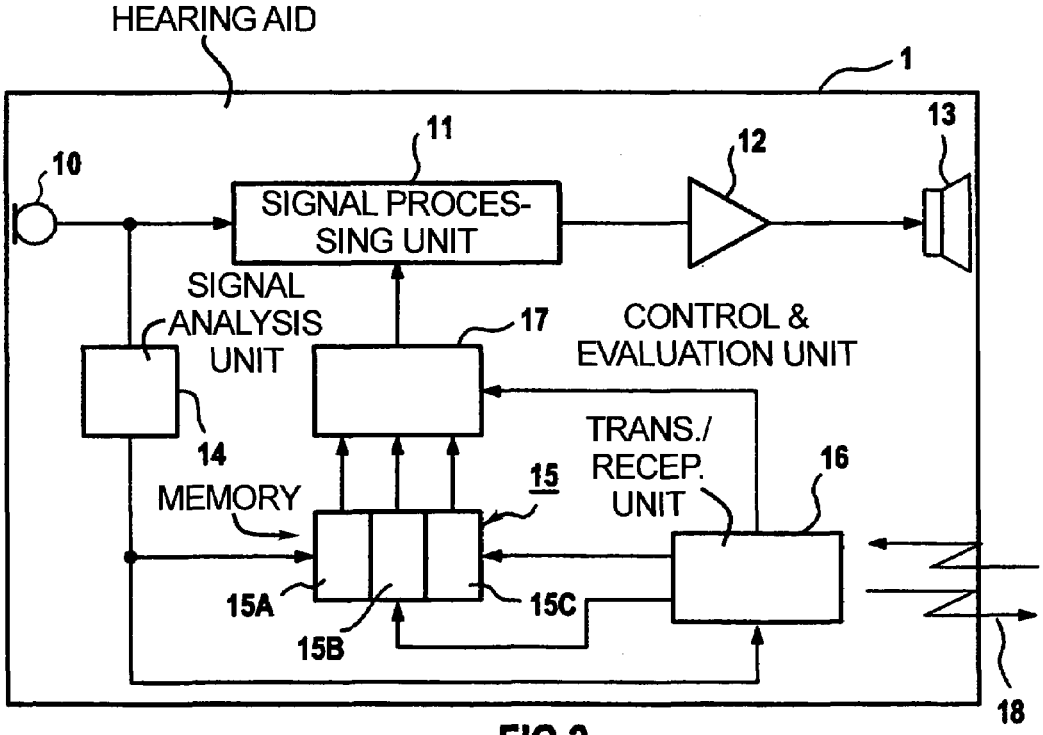
FIG. 2 is a schematic block diagram of one of the hearing aid devices in the system of FIG. 1, implemented as one of the hearing aids.

FIG. 2 schematically illustrates the internal structure of a hearing aid 1 of the hearing aid system 1, 2, 3 according to FIG. 1. The hearing aid 1 has a directional microphone 10 with variable directional characteristic for picking up an acoustic input signal. This is supplied to a signal-processing unit 11 in which an editing of the input signal for matching to the hearing loss of the hearing aid user ensues. The output signal of the signal-processing unit 11 is supplied to an output amplifier 12 and, finally, to an earphone 13 for signal output. The illustrated hearing aid 1 also has a signal analysis unit 14 in which characteristic parameters pf the acoustic field in which the hearing aid 1 is situated are identified from the inputs signal. These acoustic field characteristics characterize signal levels, frequency spectra, modulation frequencies, modulation depths, noise parts, spatial characteristics, etc., of the acoustic signals of the acoustic field. The spatial characteristics of the acoustic field can in turn include the coherence, incident directions of noise signals, the incident direction of the useful signal, etc. The acoustic field characteristics that are thus identified are deposited in a memory area 15A of a memory 15 of the hearing aid 1.

For wireless signal transmission between the hearing aid 1 and the further hearing aid 2 as well as the external processor unit 3, the hearing aid 1 comprises the transmission and reception unit 16. By means of this and the signal path 18, the acoustic field characteristics identified in the hearing aid 1 are transmitted to the hearing aid 2 and the external processor unit 3. With the transmission and reception unit 16, the hearing aid in turn receives the acoustic field characteristics analogously determined in the second hearing aid 2 and the external processor unit 3 via the signal path 18. In the exemplary embodiment, these are deposited in the memory areas 15B and 15C of the memory 15. All three memory areas 15A, 15B, 15C are supplied to the control and evaluation unit 17 that determines parameters from the acoustic field characteristics for the control of the signal-processing unit 11 in adaptation to the acoustic field. For evaluating the acoustic field and the hearing situation, the local acoustic field information as well as the information about the acoustic field at the remaining evaluation locations are present in the hearing aid 1. In this way, the hearing aid 1 has comprehensive acoustic field information available to it that is utilized for the control of the transmission parameters of the signal-processing unit 11. As in conventional hearing aids, however, this control can be based only on the consideration of the local acoustic field characteristics. Advantageously, the control and evaluation unit 17, however, accesses at least the acoustic field characteristics of both hearing aids 1 and 2 or—even better—the acoustic field characteristics at all three evaluation locations and correspondingly varies the parameters of the signal-processing unit 11. Individual hearing aid functionalities for which a matched effect of both hearing aids 1 and 2 is necessary given binaural coverage are thus synchronized. With the assistance of expedient algorithms, suitable parameters can also be determined given different characteristics for the acoustic field. Further, the acoustic field characteristics determined at different evaluation locations also allow statements with respect to the acoustic field, for example about the acoustic field geometry, which would not be possible at all given the determination of characteristics at only one evaluation location.

Since only acoustic field characteristics and not the acoustic signals picked up at the individual locations are transmitted within the hearing aid system the data volume to be transmitted is kept within limits. Nonetheless, a very exact evaluation of the acoustic field as well as a synchronization of the hearing aids and their adaptation to the acoustic field are possible.

Figure 3:
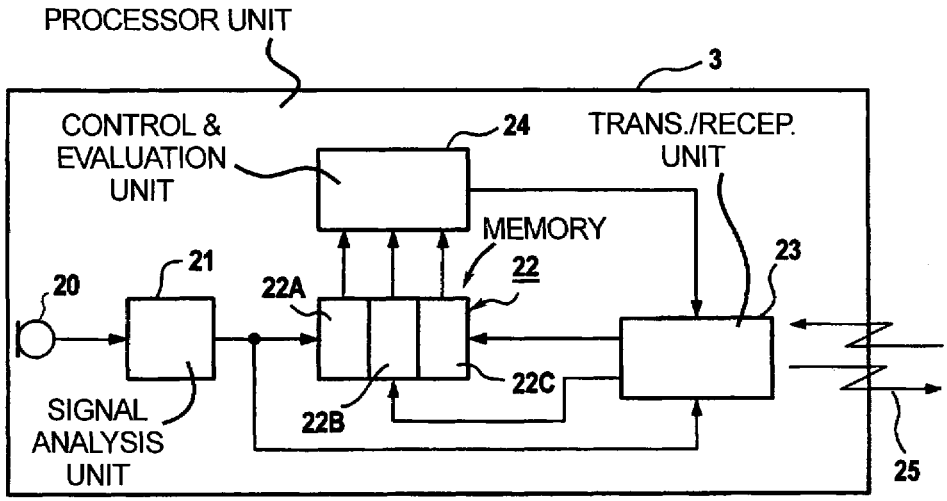
FIG. 3 is a schematic block diagram of one of the hearing aid devices in the system of FIG. 1, implemented as the external processor unit.

FIG. 3 shows the internal structure of the external processor unit 3 in the form of a remote control according to FIG. 1. This also has a microphone 20 for signal pick-up and a signal analysis unit 21 for generating acoustic field characteristics that, in one operating mode of the hearing aid system are forwarded via the transmission and reception unit 23 and the signal path 25 to the two hearing aids 1 and 2 in the hearing aid system. The acoustic field characteristics from the location of the hearing aid, as well as from the location of the other hearing aid as well as from the location of the external processor unit 3 are thus present in both hearing aids 1 and 2 in the hearing aid system. As a result, a comprehensive acoustic field analysis is enabled and, since the acoustic field characteristics are identically present in both hearing aids 1 and 2, the synchronization of the two hearing aids also is enabled.

In another operating mode of the hearing aid system that the acoustic field characteristics of all three hearing aid devices also are combined in the external processor unit 3. For this purpose, it is equipped with a memory 22 that is subdivided into the memory areas 22A, 22B, 22C. Since more space for the control and evaluation unit 24 is available in the external processor unit 3 compared to the hearing aids 1 and 2, this is fashioned correspondingly more complex, has a higher processing power and therefore enables a more comprehensive analysis of the acoustic field characteristics for determining the hearing situation. When this has been determined, then instead of the acoustic field characteristics from the location of the external signal processor, a signal for characterizing the hearing situation is directly communicated in the operating mode from the control and evaluation unit 24 to the control and evaluation unit 17 of the hearing aids 1 and 2 via the transmission and reception unit 23, the signal path 25 (that is composed of the signal paths 5 and 6 according to FIG. 1) and the transmission and reception unit 16. This signal is communicated for the adaptation of the signal-processing unit to this hearing situation.

The illustrated components of the hearing aids 1 and 2 and of the external processor unit 3 can be implemented in analog or digital circuit technology. The signal analysis units 14 and 21 as well as the control and evaluation units 17 and 24 can include neural structures and fuzzy logic for optimized determination of acoustic field characteristics, the hearing situation and parameters of the signal-processing unit 11.

Although modifications and changes may be suggested by those skilled in the art, it is the invention of the inventor to embody within the patent warranted heron all changes and modifications as reasonably and properly come within the scope of his contribution to the art.

The invention claimed is:

1. A method for operating a hearing aid system having a at least two hearing aid devices including a first hearing aid device and a second hearing aid device having a signal-processing unit adaptable to different hearing situations, and a signal path between said first and second hearing aid devices, said method comprising the steps of:

generating acoustic field characteristics of an acoustic field in said first hearing aid device and in said second hearing aid device;

transmitting the acoustic field characteristics generated in said first hearing aid device to said signal-processing unit of said second hearing aid device via said signal path; and adapting the signal-processing unit of said second hearing aid device to said acoustic field dependent on said acoustic field characteristics generated in said first hearing aid device and said acoustic field characteristics generated in said second hearing aid device.

2. A method as claimed in claim 1 wherein said first hearing aid device has a signal-processing unit and comprising the additional steps of:

transmitting the acoustic field characteristics generated in said second hearing aid device to said signal-processing unit in said first hearing aid device via said signal path; and adapting said signal-processing unit in said first hearing aid device to said acoustic field dependent on said acoustic field characteristics generated in said first hearing aid device and said acoustic field characteristics generated in said second hearing aid device.

3. A hearing aid system comprising:

a first hearing aid device having a signal analysis unit in which acoustic field characteristics of an acoustic field are determined;

a second hearing aid device, in communication with said first hearing aid device via a signal path, having a signal analysis unit for generating acoustic field characteristics of said acoustic field, and having a signal-processing unit;

said first hearing aid device transmitting the acoustic field characteristics determined in said signal analysis unit in said first hearing aid device to said signal-processing unit in said second hearing aid device, via said signal path; and said signal-processing unit in said second hearing aid device being adapted to said acoustic field dependent on said acoustic field characteristics determined in said signal analysis unit of said first hearing aid device and said acoustic field characteristics determined in said signal analysis unit of said second hearing aid device.

4. A hearing aid system as claimed in claim 3 wherein said signal path comprises a transmission unit in said first hearing aid device and a reception unit in said second hearing aid device, for wireless signal transmission between said first hearing device and said second hearing aid device.

5. A hearing aid system as claimed in claim 3 wherein said first hearing aid device comprises a signal-processing unit, and wherein said second hearing aid device transmits the acoustic field characteristics determined in said signal-processing unit of said second hearing aid device to said signal processing unit in said first hearing aid device via said signal path, and wherein said signal-processing unit in said first hearing aid device is adapted to said acoustic field dependent on said acoustic field characteristics determined in said signal analysis unit in said first hearing aid device and said acoustic field characteristics determined by said signal analysis unit in said second hearing aid device.

6. A hearing aid system as claimed in claim 5 wherein said signal path comprises a transmission/reception unit in said first hearing aid device and a transmission/reception unit in said second hearing aid device, for wireless signal transmission between said first and second hearing aid devices.

7. A hearing aid system as claimed in claim 6 wherein said first hearing aid device is a hearing aid adapted to be worn at a head, and wherein said second hearing aid device is an external processor unit.

8. A hearing aid system as claimed in claim 7 comprising a further hearing aid, identical to said first hearing aid device, adapted to be worn at said head, said hearing aid and said further hearing aid being in bi-directional communication with each other via a first signal path, and each of said hearing aid and said further hearing aid being in communication with said external processor unit via respective second and third signal paths.

9. A hearing aid system as claimed in claim 8 wherein said external processor unit comprises a remote control for at least one of said hearing aid and said further hearing aid.

10. A hearing aid system as claimed in claim 3 wherein said first hearing aid device is a hearing aid adapted to be worn at a head, and wherein said second hearing aid device is an external processor unit.

11. A hearing aid system as claimed in claim 10 wherein said external processor unit comprises a remote control for said hearing aid.

12. A hearing aid system as claimed in claim 3 wherein at least one of said signal analysis unit in said first hearing aid device and said signal analysis unit in said second hearing aid device determines signal levels of acoustic signals of said acoustic field, as said acoustic field characteristics.

13. A hearing aid system as claimed in claim 3 wherein at least one of said signal analysis unit in said first hearing aid device and signal analysis unit in said second hearing aid device determines frequency spectra of acoustic signals of said acoustic field, as said acoustic field characteristics.

14. A hearing aid system as claimed in claim 3 wherein at least one of signal analysis unit in said first hearing aid device and said signal analysis unit in said second hearing aid device determines modulation levels of acoustic signals of said acoustic field, as said acoustic field characteristics.

15. A hearing aid system as claimed in claim 3 wherein at least one of said signal analysis unit in said first hearing aid device and said signal analysis unit in said second hearing aid device determines modulation depths of acoustic signals of said acoustic field as said acoustic field characteristics.

16. A hearing aid system as claimed in claim 3 wherein at least one of said signal analysis unit in said first hearing aid device and said signal analysis unit in said second hearing aid device determines noise components of acoustic signals of said acoustic field, as said acoustic field characteristics.

17. A hearing aid system as claimed in claim 3 wherein at least one of said signal analysis unit in said first hearing aid device and said signal analysis unit in said second hearing aid device determines spatial acoustic field characteristics of said acoustic field, as said acoustic field characteristics.

18. A hearing aid system as claimed in claim 3 wherein said first hearing aid device transmits said acoustic field characteristics determined in said signal analysis unit of said first hearing aid device to said signal-processing unit in said second hearing aid device via said signal path, at periodic time intervals.

19. A hearing aid system as claimed in claim 3 wherein said signal-processing unit is adapted to said acoustic field by modifying parameters of a hearing program executed by said signal-processing unit.

20. A hearing aid system as claimed in claim 3 wherein at least one of said first hearing aid device and said second hearing aid device has an actuatable operating element, and wherein the transmission of said acoustic field characteristics from said first hearing aid device to said second hearing aid device ensues upon actuation of said operating element.

* * * * *